US006979660B2

(12) United States Patent
Tam et al.

(10) Patent No.: US 6,979,660 B2
(45) Date of Patent: Dec. 27, 2005

(54) POLYETHYLENE PROTECTIVE YARN

(75) Inventors: Thomas Y-T. Tam, Richmond, VA (US); Chok B. Tan, Richmond, VA (US); Alfred L. Cutrone, Orange, TX (US)

(73) Assignee: Honeywell International Inc., Morristown, NJ (US)

( * ) Notice: Subject to any disclaimer, the term of this patent is extended or adjusted under 35 U.S.C. 154(b) by 68 days.

(21) Appl. No.: 10/820,907

(22) Filed: Apr. 8, 2004

(65) Prior Publication Data

US 2004/0258909 A1 Dec. 23, 2004

Related U.S. Application Data

(62) Division of application No. 10/444,811, filed on May 23, 2003, now Pat. No. 6,764,764.

(51) Int. Cl.[7] ..... D01F 6/00; F41H 5/04; B32B 27/02; B32B 27/04

(52) U.S. Cl. ..... 442/108; 442/170; 428/364; 428/911; 89/36.02

(58) Field of Search ..... 428/364, 911; 442/170, 108; 89/36.02

(56) References Cited

U.S. PATENT DOCUMENTS

| | | | | |
|---|---|---|---|---|
| 4,403,012 | A | 9/1983 | Harpell et al. | 428/290 |
| 4,411,854 | A | 10/1983 | Maurer et al. | 264/205 |
| 4,413,110 | A | 11/1983 | Kavesh et al. | 526/348.1 |
| 4,422,993 | A | 12/1983 | Smith et al. | 264/210.8 |
| 4,430,383 | A | 2/1984 | Smith et al. | 428/364 |
| 4,436,689 | A | 3/1984 | Smith et al. | 264/204 |
| 4,455,273 | A | 6/1984 | Harpell et al. | 264/184 |
| 4,457,985 | A | 7/1984 | Harpell et al. | 428/224 |
| 4,501,856 | A | 2/1985 | Harpell et al. | 525/240 |
| 4,536,536 | A | 8/1985 | Kavesh et al. | 524/462 |
| 4,543,286 | A | 9/1985 | Harpell et al. | 428/288 |
| 4,545,950 | A | 10/1985 | Motooka et al. | 264/210.6 |
| 4,551,296 | A | 11/1985 | Kavesh et al. | 264/203 |
| 4,563,392 | A | 1/1986 | Harpell et al. | 428/394 |
| 4,584,347 | A | 4/1986 | Harpell et al. | 525/119 |
| 4,613,535 | A | 9/1986 | Harpell et al. | 428/113 |
| 4,623,574 | A | 11/1986 | Harpell et al. | 428/113 |
| 4,650,710 | A | 3/1987 | Harpell et al. | 428/263 |
| 4,663,101 | A | 5/1987 | Kavesh et al. | 264/178 |
| 4,681,792 | A | 7/1987 | Harpell et al. | 428/102 |
| 4,737,401 | A | 4/1988 | Harpell et al. | 428/252 |
| 4,737,402 | A | 4/1988 | Harpell et al. | 428/252 |
| 4,748,064 | A | 5/1988 | Harpell et al. | 428/113 |
| 4,820,568 | A | 4/1989 | Harpell et al. | 428/113 |
| 4,858,287 | A | 8/1989 | Maurer et al. | 28/172 |
| 4,883,700 | A | 11/1989 | Harpell et al. | 428/113 |
| 4,916,000 | A | 4/1990 | Li et al. | 428/105 |
| 4,953,234 | A | 9/1990 | Li et al. | 2/412 |
| 5,006,390 | A | 4/1991 | Kavesh et al. | 428/105 |
| 5,061,545 | A | 10/1991 | Li et al. | 428/195 |
| 5,112,667 | A | 5/1992 | Li et al. | 428/113 |
| 5,124,195 | A | 6/1992 | Harpell et al. | 428/152 |

(Continued)

*Primary Examiner*—N. Edwards
(74) *Attorney, Agent, or Firm*—Virginia Szigeti

(57) ABSTRACT

High strength polyethylene yarns useful in ballistic-resistant, cut-resistant and other applications, fabrics produced from these yarns and the methods by which the yarns and fabrics are made. An untwisted yarn of the invention comprises a plurality of filaments in essentially parallel array and from about 0.5 to 5 weight percent of a water-dispersible binder material covering less than half the surfaces of the filaments. The yarn has a tenacity greater than about 17 g/d, a tensile modulus greater than about 300 g/d, fewer than 20 entanglements/meter in a scoured state and a width less than given by the formula $$W \leq 0.055\sqrt{\sqrt{d}}$$

where W is the yarn width in millimeters under a tensile load of 0.01 g/d measured on a flat surface and d is the yarn denier.

4 Claims, 2 Drawing Sheets

U.S. PATENT DOCUMENTS 5,160,776 A 11/1992 Li et al. ..... 428/109
5,165,989 A 11/1992 Bhatnagar et al. ..... 428/245
5,167,876 A 12/1992 Lem et al. ..... 252/602
5,175,040 A 12/1992 Harpell et al. ..... 428/113
5,185,195 A 2/1993 Harpell et al. ..... 428/102
5,187,023 A 2/1993 Prevorsek et al. ..... 442/228
5,190,802 A 3/1993 Pilato ..... 428/111
5,196,252 A 3/1993 Harpell et al. ..... 428/102
5,248,471 A 9/1993 Kavesh ..... 264/184
5,330,820 A 7/1994 Lin et al. ..... 428/113
5,343,796 A 9/1994 Cordova et al. ..... 89/36.02
5,376,426 A 12/1994 Harpell et al. ..... 428/109
5,440,965 A 8/1995 Cordova et al. ..... 89/36.02
5,471,906 A 12/1995 Bachner, Jr. et al. ..... 89/36.05
5,480,706 A 1/1996 Li et al. ..... 428/113
5,525,414 A * 6/1996 Wagers et al. ..... 442/108
5,552,208 A 9/1996 Lin et al. ..... 428/113
5,578,374 A 11/1996 Dunbar et al. ..... 428/364
5,587,230 A 12/1996 Lin et al. ..... 428/245
5,677,029 A 10/1997 Prevorsek et al. ..... 428/113
5,736,244 A 4/1998 Kavesh et al. ..... 428/364
5,741,451 A 4/1998 Dunbar et al. ..... 264/103
5,788,907 A 8/1998 Brown, Jr. et al. ..... 264/280
5,804,015 A 9/1998 McCarter et al. ..... 156/209
5,958,804 A 9/1999 Brown, Jr. et al. ..... 442/192
5,972,498 A 10/1999 Kavesh et al. ..... 428/364
6,003,424 A 12/1999 Cordova et al. ..... 89/36.02
6,219,842 B1 4/2001 Bachner, Jr. ..... 2/2.5
6,248,676 B1 6/2001 Dischler ..... 442/101
6,268,301 B1 7/2001 Dalman et al. ..... 442/217
6,276,254 B1 8/2001 Cordova et al. ..... 89/36.02
6,448,359 B1 9/2002 Kavesh ..... 526/352
6,713,413 B2 * 3/2004 Kruegler ..... 442/272
6,764,764 B1 * 7/2004 Tam et al. ..... 428/375

* cited by examiner

POLYETHYLENE PROTECTIVE YARN

POLYETHYLENE PROTECTIVE YARN

This application is a divisional of application Ser. No. 10/444,811 filed May 23, 2003 now U.S. Pat No. 6,764,764.

BACKGROUND OF THE INVENTION

1. Field of the Invention

This invention relates to improved, high strength polyethylene yarns useful in ballistic-resistant, cut-resistant and other applications, fabrics produced from these yarns and the methods by which the yarns and fabrics are made.

2. Description of the Related Art

Among the requirements that protective clothing such as personal body armor, chain saw chaps, and others must meet, in addition to ballistic-resistance and/or cut resistance, are comfort and flexibility. Multiple layers of woven fabrics consisting of high strength and high modulus fibers are commonly used in such protective clothing.

The preparation of high strength, polyethylene filaments and/or multi-filament yarns has been described for example in U.S. Pat. Nos. 4,411,854, 4,413,110, 4,422,993, 4,430,383, 4,436,689, 4,455,273, 4,536,536, 4,545,950, 4,551,296, 4,584,347, 4,663,101, 5,248,471, 5,578,374, 5,736,244, 5,741,451, 5,972,498 and 6,448,359 B1. Ballistic-resistant articles prepared from such high strength polyethylene filaments have been described for example in U.S. Pat. Nos. 4,403,012, 4,457,985, 4,623,574, 4,650,710, 4,737,401, 4,737,402, 4,748,064, 4,883,700, 4,916,000, 5,061,545, 5,160,776, 5,167,876, 5,175,040, 5,187,023, 5,196,252, 5,343,796, 5,376,426, 5,440,965, 5,480,706, 5,677,029, 5,788,907, 5,804,015, 5,958,804, 6,003,424, and 6,276,254 B1.

U.S. Pat. No. 4,403,012 indicates that the fibers may be formed into a fabric by any of a variety of conventional techniques. U.S. Pat. No. 4,737,401 broadly indicates that plain woven, basket woven, satin and crow feet woven fabrics, etc., can be made from high strength polyethylene filaments. However, to efficiently use conventional weaving equipment, the yarns to be woven must have some minimum degree of yarn coherence to avoid snags and wild loops which effect fabric quality and may stop the loom. Weaving is also enhanced when the yarn to be woven is essentially round in cross-section and does not flatten when passing over guides. On the other hand, for maximum ballistic-effectiveness it is desirable that the yarns in woven fabrics are flat and are spread out into thin layers.

Methods to achieve yarn coherence have included twisting, jet entanglement, and application of sizing material. Twisting improves the roundness of yarn bundles but it is known that twisting reduces the ballistic effectiveness of fabrics produced from these yarns. This may be in part because twisting induces stress in the yarns and in part because twisting prevents the woven yarns from spreading into thin layers.

Air jet entanglement of yarn filaments as taught, for example, by U.S. Pat. No. 5,579,628, provides yarn coherence and improves ballistic-resistance as compared to twisted yarns. However, air jet entanglement may also damage the yarn and is an expensive process in both capital costs for air compressors and in operating costs for energy consumption.

Sizing of a plain weave fabric made from untwisted high strength polyethylene filaments with polyvinyl alcohol has previously been described in U.S. Pat. No. 4,737,401. A process that covered virtually all yarn surfaces of synthetic filament yarns with sizing has been described in U.S. Pat. No. 4,858,287.

Each of the methods and yarns cited above represented improvements in the state of their respective arts. Nevertheless, none described the specific constructions of the yarns and fabrics of this invention and the methods by which they are achieved.

SUMMARY OF THE INVENTION

The invention is an untwisted polyethylene yarn comprising: a plurality of filaments in essentially parallel array and from about 0.5 to 5 weight percent of a water-dispersible binder material covering less than half the surfaces of said filaments. The yarn has a tenacity greater than about 17 grams/denier (g/d) and a tensile modulus (modulus of elasticity) greater than about 300 g/d as measured by ASTM D2256, fewer than 20 entanglements/meter in a scoured state and has a width satisfying the following formula $$W \leqq 0.055\sqrt{d}$$

where W is the yarn width in millimeters under a tensile load of 0.01 grams per denier measured on a flat surface, and d is the yarn denier. The requirement for the yarn width expressed by the above formula insures sufficient yarn roundness for good weaving capability.

The invention is also a protective fabric comprising in majority portion the yarn described above.

The invention is also an improvement to a process for the preparation of untwisted polyethylene yarns comprising a plurality of essentially parallel filaments, said yarns having a tenacity greater than about 17 g/d, a modulus greater than about 300 g/d, and fewer than 20 entanglements/meter. The improvement comprises applying about 0.5 to 5 wt. % of a water-dispersible binder material so as to cover less than half the surfaces of the filaments during a last drawing step under a tension greater than about 2 grams/denier (g/d).

The invention is also an improvement to a process for the preparation of a very low creep, ultra high modulus, low shrink, high tenacity polyethylene multiple filament yarn, comprising:

a) drawing a high molecular weight polyethylene yarn at a temperature within 10° C. of its melting temperature to form a drawn, highly oriented polyethylene yarn;

b) then poststretching the yarn at a drawing rate of less than about 1 second$^{-1}$ at a temperature within 10° C. of its melting temperature, and cooling the yarn under tension sufficient to retain its highly oriented state.

The improvement comprises applying to the yarn about 0.5 to 5 wt. % of a water-dispersible binder material so as to cover less than half the surfaces of the filaments during one of drawing step a) or poststretching step b) under a tension greater than about 2 grams/denier.

The invention is also a process for the preparation of a protective fabric comprising the steps of: weaving a fabric comprising in majority portion the yarn described above; scouring the fabric to remove the water-dispersible binder material and flattening the yarn.

DETAILED DESCRIPTION OF THE INVENTION

An objective of this invention is the provision of a high strength, high tensile modulus polyethylene yarn having a coherence and roundness suitable for weaving into a protective fabric and which flattens and spreads out when the fabric is scoured. The invention is an untwisted polyethylene yarn comprising a plurality of filaments in essentially parallel array and from about 0.5 to 5 weight percent of a water-dispersible binder material covering less than half the surfaces of said filaments. The yarn has a tenacity greater than about 17 g/d, a tensile modulus greater than about 300 g/d, fewer than about 20 entanglements/meter in a scoured state and has a width satisfying the following formula $$W \leq 0.055\sqrt{d}$$

where W is the yarn width in millimeters under a tensile load of 0.01 grams per denier measured on a flat surface, and d is the yarn denier. The requirement for the yarn width expressed by this formula insures sufficient yarn roundness for good weaving. Preferably, the yarn width (W) satisfies the following formula $$W \leq 0.055\sqrt{d}$$

where W is the yarn width in millimeters under a tensile load of 0.01 grams per denier measured on a flat surface, and d is the yarn denier. The woven fabric is especially useful in applications requiring ballistic-resistance and/or cut resistance, more preferably the former.

Figure 1:
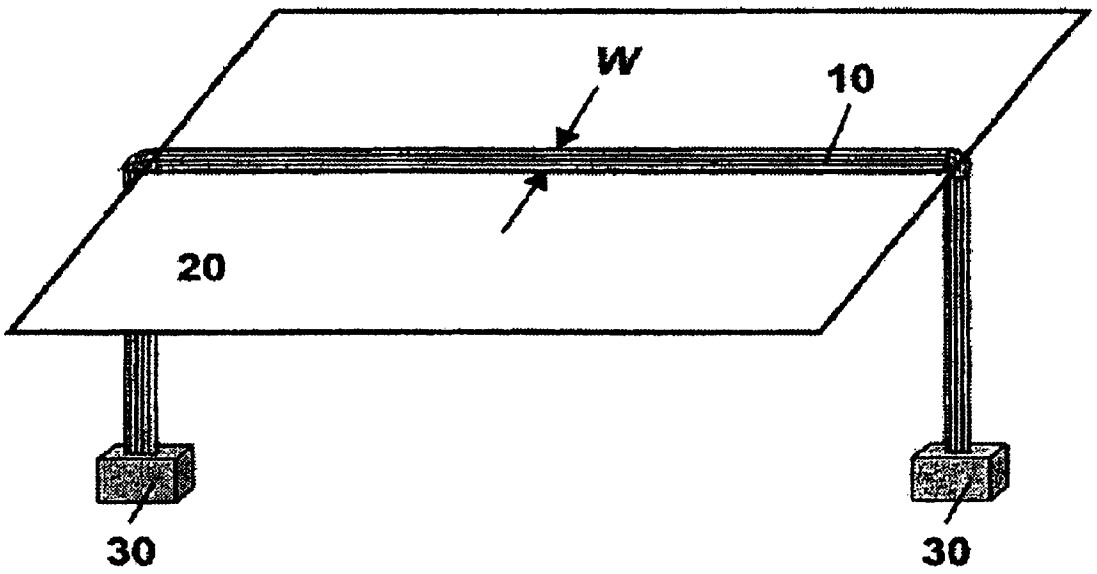
FIG. 1 illustrates a method of measuring the width of a yarn.

FIG. 1 illustrates the method of yarn width measurement. A length of yarn 10 is attached at each end to weights 30 and placed across a flat plate 20. At least 7 cm of the yarn are in contact with the flat plate. The flat plate is conveniently chosen to be the stage of an optical microscope. The weights 30 are chosen in relation to the yarn denier so as to produce a tension in the yarn of 0.01 g/d. The width W of the yarn bundle lying on the flat plate 20 is measured by appropriate means, such as an optical microscope, averaging at least five measurements at different points along a 5 cm length.

When the yarn has some degree of twist, the yarn width W is measured along a yarn length at least twice the twist periodicity, and is the maximum (as opposed to average) measurement taken along this length.

The number of entanglements per meter is measured after scouring the yarn to remove the binding material. "Entanglements" are interlocked filaments that cannot be readily separated. Entanglements may be formed during the process of spinning multiple filaments. The number of entanglements/meter is measured by the method of ASTM D4724-99, with the modification that the apparatus used is the Model HW70735 Interlace Tester manufactured by Industrial Machine Works, Waynesboro, Va. Preferably, the yarn of the invention has fewer than about 10 entanglements/meter in the scoured state.

The percentage of the filament surfaces that are covered by the water-dispersible binder material is determined using a microscope with digital image analysis software, such as IMAGE-PRO® software from Media Cybernetics, Silver Spring, Md. To aid in the measurement, the binder material may be selectively dyed to enhance contrast by using a water-soluble dye that is not absorbed by polyethylene.

The water-dispersible binder material is preferably selected from the group consisting of: a salt of an acrylic copolymer, sodium carboxymethyl cellulose, polyethylene oxide, polypropylene oxide, ethylene oxide/propylene oxide copolymers, polyvinyl alcohol, modified starch, esterified starch, cationic starch, starch-styrene/butadiene copolymer, and mixtures thereof. Preferably, the water-dispersible binder forms about 0.5 to about 3 wt. % of the yarn of the invention. It will be understood that the terms "weight percent" or "wt. %" have the conventional meaning of weight of binder per weight of filaments plus binder.

The untwisted yarn of the invention is produced by an improvement to a process for the preparation of polyethylene yarns having a plurality of filaments in essentially parallel array, a tenacity greater than about 17 g/d, a tensile modulus greater than about 300 g/d and fewer than about 20 entanglements/meter in a scoured state. The improvement comprises the application of about 0.5 to 5 wt. % of a water-dispersible binder material so as to cover less than half the surfaces of said filaments during a last drawing step under a tension of greater than about 2 grams/denier, more preferably under a tension of greater than about 3 grams/denier. Preferably, the last drawing step is at an elevated temperature between about 110° C. and about 160° C.

Surprisingly, the application of the binder material when the yarn is under substantial tension is believed to be a key factor in achieving superior ballistic effectiveness in fabric woven from the yarn. Without being held to a particular theory of why the invention works, it is believed that application of the binder material when the yarn is under substantial tension prevents complete wetting of the surfaces of the filaments. The binder forms limited area binding points between filaments sufficient to provide cohesion to the yarn for weaving, but not sufficient to reduce ballistic effectiveness. Moreover, the limited area binding points are more readily removed by scouring to achieve maximum ballistic effectiveness.

An untwisted polyethylene yarn having a plurality of essentially parallel filaments, a tenacity greater than about 17 g/d, a tensile modulus greater than about 300 g/d and fewer than about 20 entanglements/meter is preferably produced by any of the processes described by U.S. Pat. Nos. 4,413,110, 4,551,296, 4,663,101, and 6,448,359 B1, all incorporated herein by reference to the extent not incompatible herewith.

Figure 2:
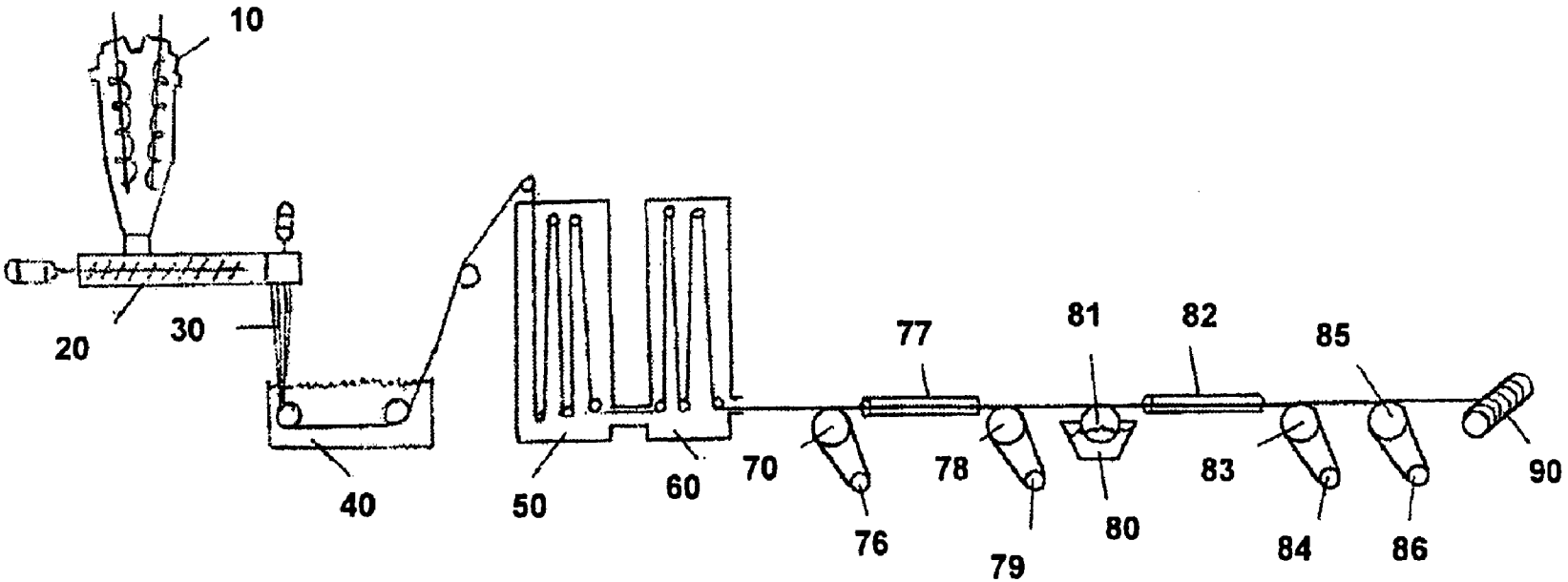
FIG. 2 illustrates a process for producing a yarn of the invention.

FIG. 2 illustrates one embodiment of the process of the invention. Ultra-high molecular weight polyethylene and mineral oil are charged to a mixer 10 maintained at elevated temperature. The partially dissolved polyethylene is passed to a screw extruder 20 which may be a single screw extruder or a twin screw extruder wherein the formation of a polyethylene solution is completed. Solution filaments 30 are spun through an air gap into a water quench bath 40 wherein the solution filaments are cooled and solidified to gel filaments. The solution filaments may be stretched on passing through the air gap to the quench bath. The gel filaments are passed in sequence through a washer cabinet 50 in contact with a low boiling extraction solvent to remove the mineral oil and then through a drying cabinet 60. The gel filaments may be stretched between the quench bath and the washer cabinet and through the washing and drying cabinets. The extracted and dried multi-filament yarn is passed continuously from the drying cabinet over a driven heated godet 70 and associated idler roll 76, through a first heated tube 77 and onto a second driven heated godet 78, and associated idler roll 79, operating at higher speed. The yarn is thereby stretched in the heated tube 77. The yarn next passes under a tension greater than about 2 g/d in kissing contact with an applicator roll 81 partially immersed in an aqueous solution 80 of a binding agent. The yarn containing the binding agent is dried and stretched again on passing through heated tube 82 to driven heated godet 83 and associated idler roll 84 operating at higher speed than associated rolls 78 and 79. After the last elevated temperature stretch, the yarn is passed under tension over a driven cold godet 85 and associated idler roll 86 and collected without twist on a winder 90. The heated godets and heated tubes are typically at temperatures between about 110° C. and about 160° C. As used herein, the term "elevated temperature" means a temperature within that range.

The untwisted yarn so produced has filaments in essentially parallel array, a tenacity greater than 17 g/d, a tensile modulus greater than about 300 g/d, fewer than 20 entanglements per meter in a scoured state, about 0.5 to 5 vol % of a water-dispersible binding agent covering less than half the surfaces of the filaments, and a width in millimeters less than given by 0.055 times the square root of the yarn denier.

Preferably the yarn of the invention is produced by an improvement to the process of U.S. Pat. No. 5,741,451, incorporated herein by reference to the extent not incompatible herewith. This process comprises the preparation of a very low creep, ultra high modulus, low shrink, high tenacity polyethylene multiple filament yarn by: a) drawing a high molecular weight polyethylene yarn at a temperature within 10° C. of its melting temperature to form a drawn, highly oriented polyethylene yarn; b) then poststretching the yarn at a drawing rate of less than about 1 second$^{-1}$ at a temperature within 10° C. of its melting temperature, and cooling said yarn under tension sufficient to retain its highly oriented state. The improvement comprises applying to the yarn about 0.5 to 5 wt. % of a water-dispersible binder material so as to cover less than half the surfaces of the filaments during one of drawing step a) or poststretching step b) under a tension greater than about 2 grams/denier.

The protective woven fabric of the invention, preferably ballistic-resistant, comprises in majority portion an untwisted polyethylene yarn comprising: a plurality of filaments in essentially parallel array and about 0.5 to 5 wt. % of a water-dispersible binder material covering less than half the surfaces of said filaments. The yarn has a tenacity greater than about 17 g/d and a tensile modulus (modulus of elasticity) greater than about 300 g/d as measured by ASTM D2256, fewer than 20 entanglements/meter in the scoured state and a width satisfying the following formula $$W \leq 0.055\sqrt{d}$$

where W is the yarn width in millimeters under a tensile load of 0.01 grams per denier measured on a flat surface, and d is the yarn denier.

The woven fabric of the invention may be plain woven, basket woven, satin or crowfeet woven or any other standard weave. It is preferred that the yarns in the fabric have as few out-of-plane bends as possible. An eight-harness satin weave is particularly preferred.

It is also preferred that the fabrics of the invention are scoured and/or calendered to flatten and spread the yarns, thereby enhancing their ballistic-resistance. It is most preferred that the fabrics of the invention are both scoured and calendered, with calendering preferably occurring after scouring.

The ballistic-resistant woven fabric of the invention possesses at least 5% greater specific energy absorption when impacted with a 9 mm FMJ bullet at its V50 velocity than a woven fabric having the same construction using polyethylene yarns having the same tenacity and tensile modulus but having more than 20 entanglements/meter and/or greater twist.

COMPARATIVE EXAMPLE 1

The widths were measured of commercially available untwisted high strength, high modulus polyethylene yarns. Table I below sets forth the yarn deniers and the measured yarn widths in comparison with 0.055 times the square root of the yarn denier. Each of these yarns had about 8 entanglements/meter.

TABLE I

| Yarn Denier | Yarn Width, mm | 0.055 $\sqrt{\text{denier}}$, mm |
|---|---|---|
| 1200 | 2.5 | 1.91 |
| 650 | 1.7 | 1.40 |
| 375 | 2.8 | 1.07 |
| 215 | 2.1 | 0.81 |

It is seen that each of the prior art, untwisted yarns had yarn widths that exceeded 0.055 times the square root of the yarn denier.

COMPARATIVE EXAMPLE 2

A 60 filament, 650 denier highly oriented polyethylene yarn having a tenacity of 30 g/d, a tensile modulus of 970 g/d, and a main melting point of 147° C., as measured by differential scanning calorimetry (DSC) at a heating rate of 10° C./min, was prepared by the process of U.S. Pat. No. 4,663,101.

A number of packages of this yarn were post-stretched by the process of U.S. Pat. No. 5,741,451. The yarn packages were placed on a creel and fed from the creel over a set of driven rolls into a post-stretching oven at a temperature of 156° C. and thence to a second set of driven rolls operating at a speed 2.63 times faster than the first set. The yarns were thereby stretched 2.63:1 between roll sets at a temperature within 10° C. of their melting point. The plurality of yarns leaving the second set of driven rolls was passed through a second post-stretching oven at temperature of 154° C. to a third set of driven rolls operating at a speed 1.2 times faster than the second set. The yarns passing through the second post-stretching oven were thereby stretched an additional 1.2:1. Yarn tension between the second and third sets of driven rolls was 4 g/d. Each yarn leaving the third set of driven rolls was cooled under a tension of 2 g/d and then wound on individual packages.

The wound yarns consisting of 60 essentially parallel filaments were of 215 denier, having a tenacity of 38 g/d, a tensile modulus of 1320 g/d, a main melting point of 148° C. as measured by DSC, no twist, 8 entanglements/meter and a width measured under a tension of 0.01 g/d of 2.1 mm. As the yarn width of 2.0 mm exceeded 0.055 times the square root of 215 (0.81 mm), and as the yarn contained no binder material, this was not a yarn of the invention.

Some packages of these yarns were put aside for later twisting (see Comparative Examples 3 and 4). Other packages of these yarns were rewound onto a warp beam and placed on a loom manufactured by Lindauer DORNIER GmbH. Still other packages of these same yarns were used for the weft. An attempt to weave a plain weave fabric produced many snags, tight ends and operating difficulties. A plain weave fabric was nevertheless prepared having wild filaments, slubs and irregular yarn spacings. On average the fabric had 17.7 warp and weft yarns per centimeter, an areal density of 88 g/m$^2$ and a thickness of 0.15 mm. Forty-two sheets of this fabric were plied up to an areal density of 3.69 kg/m$^2$ and subjected to ballistic testing by NIJ Standard 0101.03 using a 9 mm 124 grain FMJ bullet. According to this method, samples are placed on a clay backing, and shot 16 times. The protective power of the sample is expressed by citing the impacting velocity at which 50% of the projectiles are stopped. This is designated the V50 velocity. The specific energy absorption (SEA) is the kinetic energy of the projectile at the V50 velocity in Joules, divided by the areal density of the sample, kg/m$^2$. SEA has units of J-m$^2$/kg.

COMPARATIVE EXAMPLE 3

Some of the same 60 filament, 215 denier yarns prepared in Comparative Example 2 were twisted to 1.2 turns/cm on a MEADOWS Model 805-M ring twister. The twisted yarns were used as the warp and weft of a plain weave fabric having 17.7×17.7 yarns/cm. No difficulty was experienced in the weaving operation. The woven fabric had an areal density of 88 g/m$^2$ and a thickness of 0.15 mm. The fabric was cut into 46 cm squares, stacked to an areal density of 3.67 kg/m$^2$ and subjected to ballistic testing by NIJ Standard 0101.03 using a 9 mm 124 grain FMJ bullet. The V50 velocity was 378 meters/sec and the specific energy absorption was 32.0 J-m$^2$/kg.

COMPARATIVE EXAMPLE 4

Some of the same 60 filament, 215 denier yarns prepared in Comparative Example 2 were twisted to 2 turns/cm on a MEADOWS Model 805-M ring twister. The twisted yarns were used as the warp and weft of a plain weave fabric having 22×22 yarns/cm. No difficulty was experienced in the weaving operation. The woven fabric had an areal density of 111 g/m$^2$ and a thickness of 0.17 mm. The fabric was cut into 46 cm squares, stacked to an areal density of 3.67 kg/m$^2$ and subjected to ballistic testing by NIJ Standard 0101.03 using a 9 mm 124 grain FMJ bullet. The V50 velocity was 421 meters/sec and the specific energy absorption was 39.8 J-m$^2$/kg.

EXAMPLE OF THE INVENTION

Sixty-filament polyethylene yarns were produced exactly as described in Comparative Example 2 with the exception that before entering the second post-stretching oven and after passing over the second set of driven rolls, the yarns, while under a tension of 4 g/d, made kissing contact with a roll rotating in a 7.5 wt. % aqueous emulsion of PENFLEX™ starch styrene butadiene copolymer from Penford Products Co., Cedar Rapids, Iowa. The yarns were dried and post-stretched and in the second post-stretching oven under the same conditions as in Comparative Example 2, cooled under 2 g/d tension and wound on individual rolls.

The untwisted polyethylene yarns of the invention consisted of sixty essentially parallel filaments and about 2.5 wt. % of water-dispersible binder material covering less than half the surface area of the filaments. The yarns were of 220 denier, had a tenacity of 37 g/d, a tensile modulus of 1290 g/d, a main melting point of 148° C. as measured by DSC, no twist, 8 entanglements/meter in a scoured state, and a width of 0.58 mm measured under a tension of 0.01 g/d. The yarn width was less than 0.055 times the square root of the denier.

A plain weave fabric having 17.7 warp and weft yarns per centimeter, an areal density of 90 g/m$^2$ and a thickness of 0.15 mm was readily woven from these yarns without difficulty. Sheets of this fabric were plied up to an areal density of 3.69 kg/m$^2$ and subjected to ballistic testing by NIJ Standard 0101.03 using a 9 mm 124 grain FMJ bullet. The V50 velocity was 445 meters/sec. SEA was 44.3 J-m$^2$/kg.

The V50 velocity of this fabric of the invention was 17.7% greater and the SEA was 38% greater than for the fabric of Comparative Example 3 having the same construction, and woven from twisted yarns having the same tenacity and tensile modulus. Suprisingly, the V50 velocity of this fabric of the invention was also 5.7% greater and the SEA was 11% greater than for the finer weave fabric of Comparative Example 4, also woven with twisted yarns.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A woven fabric comprising in majority portion a yarn wherein the yarn is an untwisted polyethylene yarn comprising: a plurality of filaments in essentially parallel array and about 0.5 to 5 weight percent of a water-dispersible binder material covering less than half the surfaces of said filaments; said yarn having a tenacity greater than about 17 grams/denier and a tensile modulus greater than about 300 grams/denier as measured by ASTM D2256, fewer than about 20 entanglements/meter in a scoured state, and having a width satisfying the following formula $$W \leqq 0.055\sqrt{d}$$

where W is the yarn width in millimeters under a tensile load of 0.01 grams per denier measured on a flat surface, and d is the yarn denier.

2. The woven fabric of claim 1 in a scoured state.

3. A ballistically-resistant woven fabric of claim 1 having at least 5% greater specific energy absorption when impacted with a 9 mm FMJ bullet at its V50 velocity than a woven fabric having the same construction using polyethylene yarns having the same tenacity and tensile modulus but having more than 20 entanglements/meter or being twisted.

4. A ballistically-resistant woven fabric of claim 2 having at least 5% greater specific energy absorption when impacted with a 9 mm FMJ bullet at its V50 velocity than a woven fabric having the same construction using polyethylene yarns having the same tenacity and tensile modulus but having more than twenty entanglements/meter or being twisted.

* * * * *